United States Patent [19]

Bartko et al.

[11] Patent Number: 4,672,833

[45] Date of Patent: Jun. 16, 1987

[54] METHOD AND APPARATUS FOR THE TWO-STEP ROLLING OF RINGS

[75] Inventors: Kristine Bartko, Dohma; Dieter Gäbler, Karl Marx Stadt; Peter Heinrich, Karl Marx Stadt; Joachim Luckner, Karl Marx Stadt; Bernd Schlenkrich, Karl Marx Stadt, all of German Democratic Rep.

[73] Assignee: VEB Kombinat Wälzlager und Normteile, Karl Marx Stadt, German Democratic Rep.

[21] Appl. No.: 790,544

[22] Filed: Oct. 23, 1985

[30] Foreign Application Priority Data

Nov. 26, 1984 [DD] German Democratic Rep. ... 269866

[51] Int. Cl.[4] ..... B21H 1/12

[52] U.S. Cl. ..... 72/111; 72/106

[58] Field of Search ..... 72/105, 106, 110, 111

[56] References Cited

U.S. PATENT DOCUMENTS

| | | | |
|---|---|---|---|
| 899,436 | 9/1908 | Ritter | 72/111 |
| 1,661,024 | 2/1928 | Venable | 72/111 |
| 2,925,003 | 2/1960 | McMullen et al. | 72/106 |
| 3,681,962 | 8/1972 | Marcovitch | 72/106 |
| 3,822,574 | 7/1974 | Krupin et al. | 72/110 |

*Primary Examiner*—Lowell A. Larson

*Attorney, Agent, or Firm*—Jordan and Hamburg

[57] ABSTRACT

Method and apparatus are provided for the two-step rolling of predominantly profiled rings, for example, anti-friction bearing rings, with diameter enlargement in two rolling steps in one working sequence for the considerable reduction of the stress on the rolling mandrel.

2 Claims, 2 Drawing Figures

METHOD AND APPARATUS FOR THE TWO-STEP ROLLING OF RINGS

BACKGROUND OF THE INVENTION AND RELATED ART STATEMENT

The invention relates to a method and an automatically functioning apparatus required for the execution of the method for the rolling of predominantly profiled rings, for example anti-friction bearing rings, with diameter enlargement in two rolling steps in one working sequence for the considerable reduction of the stress on the rolling mandrel. The invention can be used preferably in the anti-friction bearing industry for the production of anti-friction bearing rings of relatively small diameters for which, up to now, there has been required a finishing machining.

For the production of ring-shaped workpieces there are known several rolling methods and apparatuses, which predominantly function according to the roller-mandrel principle.

The workpiece is mounted on the mandrel and is re-shaped between the mandrel and the roller such that under the effect of the re-shaping force, the thickness of the wall is reduced, and at a width which is kept constant, the diameters are enlarged. During the re-shaping there occurs, in particular, a strengthening of the material of the ring and as a result thereof, an increase of the required rolling force.

For the rolling of profiled rings, for example, anti-friction bearing rings, there is required a minimum wall thickness of the initial part so that the profile can be completely rolled out. Because of the constant width and the constancy of volume, thus there result relatively small diameters for the initial part, whereby the borehole diameter determines the maximum possible mandrel diameter.

The mandrel of very small rolling diameter, which is due to the flow of the raw material, has to transmit in the end phase the maximum required re-shaping force, which leads to high stresses in the rolling mandrel. As an essential disadvantage, the practicability of the method is therefore limited to small ring diameters.

The object of the invention is to eliminate the aforementioned disadvantages of the prior art and to make rolling technically and economically applicable even for rings of relatively small diameters by eliminating the up to now required finishing machining, realizing with stabilization of the entire rolling process and reduction of ancillary time a considerable material saving at high working productivity.

SUMMARY OF THE INVENTION

The object of the invention is to provide a rationalized method and a corresponding apparatus, which make possible the manufacture by means of rolling of rings of even smaller diameters.

As far as the method is concerned, the object is attained in that rings of smaller diameters, for example, anti-friction bearing rings, are rolled in a first rolling step at a low rolling force up to a self-adjusting or a specific intermediate diameter, and in a second rolling step at the maximum required rolling force to the final diameter in one working sequence on an apparatus.

The rolling process thereby is performed with a roller holding the finished profile and a rolling mandrel holding the rough profile and the finished profile, whereby the ring does not change its rolling position.

A backing-up roller carrier which is movable in the radial direction in relation to the roller, remains via the backing-up rollers operatively connected to the ring and the roller, even if the ring is not making contact with the rolling mandrel.

As far as the apparatus is concerned, the object is attained by means of axially adjustable bearing housings which are arranged at both sides of the ring to be rolled. In one of the bearing housings, a two-step recessed rolling mandrel bearing the rough-rolling profile and the finish-rolling profile is supported so that it resists rotation and is axially adjustable in a known way in a base bushing.

On the opposite side there is another bearing housing with a sleeve which is supported so that it resists rotation and is axially adjustable in a base bushing, the sleeve having a borehole of the diameter of the rough-rolling profile for receiving the plug of the rolling mandrel and an external diameter of the finish-rolling profile. Thereby it is made possible to support the shaft of the rolling mandrel in the borehole of the base sleeve.

In the following, the invention will be explained in greater detail on an apparatus for the execution of the method.

BRIEF DESCRIPTION OF THE DRAWINGS

The drawings shows the production of an anti-friction bearing ring having a relatively small diameter in the drawing.

Figure 1:
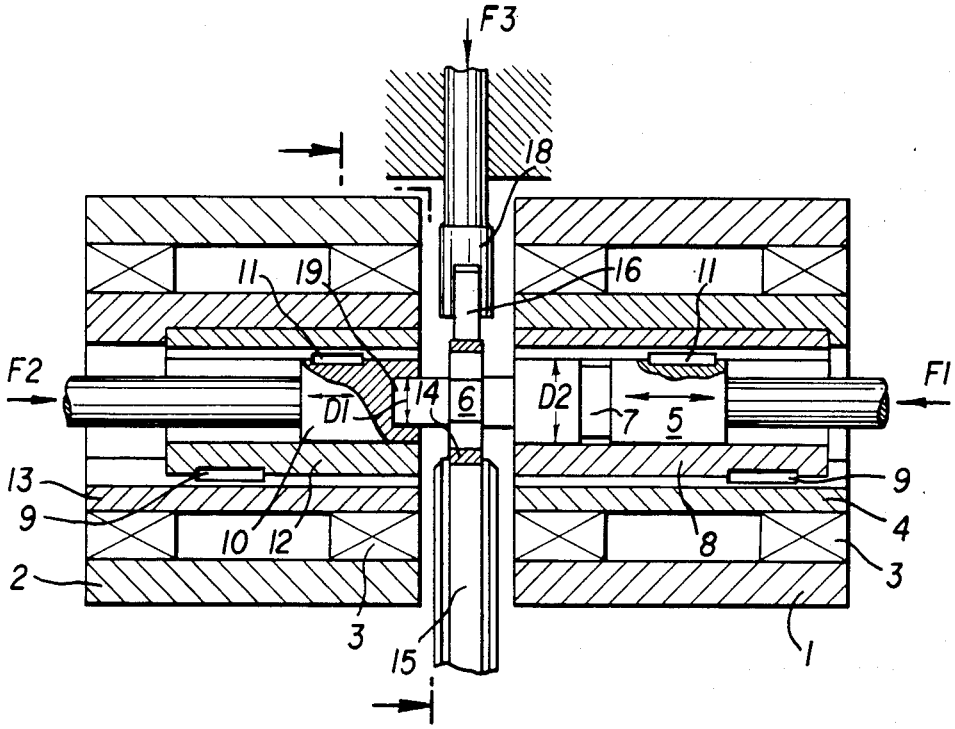
FIG. 1 is a cross-sectional view of the bearing of the rolling mandrel.

According to FIG. 1, on a joint base structure, which is not illustrated, two bearing housings 1, 2 are axially adjustably mounted and between them are arranged a roller 15 and the backing-up roller carrier 18.

In the bearing housing 1 a hollow shaft 4 is supported by the bearing 3. A rolling mandrel 5 with the rough-rolling profile 6 and the finish-rolling profile 7 is arranged in the hollow shaft 4 so that it resists rotation and is axially adjustable with respect to the base bushing 8 by means of the drivers 9, 11. For receiving the plug of the rolling mandrel 5 with the diameter D1 of the rough-rolling profile 6, a sleeve 10 is provided with a borehole 19, whereby the external diameter of the sleeve 10 corresponds to the diameter D2 of the finish-rolling profile 7. Via the drivers 9, 11, the sleeve 10 is connected so that it resists rotation and via a base bushing 12 it is axially adjustably connected to the hollow shaft 13 and is supported in the bearing housing 2 by the bearing 3.

Figure 2:
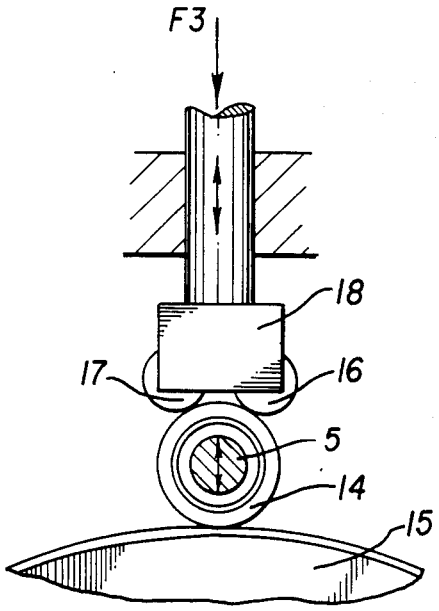
FIG. 2 is a cross-sectional view taken along the direction of the arrows associated with the section line.

Over the rolling mandrel 5 is arranged the ring 14 to be rolled. FIG. 2 shows the ring 14 with the rolling mandrel 5 between the roller 15 and the backing-up rollers 16, 17, which are arranged in the backing-up roller carrier 18, which is guided in the base structure.

In the starting position the rolling mandrel 5 and the backing-up roller carrier 18 with the backing-up rollers 16, 17 are in the rear position, the sleeve 10 is in the frontal position. At the start of the rolling process the rolling mandrel 5 is inserted by means of the effective mandrel closing force F1 through the inserted ring 14 up to the borehole 19 of the sleeve 10. Because of a considerably greater bracing force F2, which acts via the sleeve 10 against an inner stop, which is not illustrated, the rolling mandrel 5 is safely held in this rough-rolling position and the rolling of the first step takes place.

With the introduction of the backing-up roller force F3, shortly before finishing the rough-rolling, the backing-up rollers 16, 17, which are supported in the backing-up roller carrier 18, are pressed towards the ring 14. In this finish-rolling position the ring 14 having an enlarged diameter is safely held by means of the backing-up rollers 16, 17 and the roller 15 without thereby making contact with the rolling mandrel 5.

With the reduction of the bracing force F2 to less than the mandrel closing force F1, the rolling mandrel 5 moves with the sleeve 10, which acts against an external stop, which is not illustrated, through the ring 14 which is concentrically held in relation to it by means of the backing-up rollers 16, 17, whereby the shaft having the diameter D2 of the finish-rolling profile 7 is inserted in the borehole of the base bushing 12.

After the finish-rolling, the sleeve 10 is brought in the frontal position by means of the bracing force F2, and by means of the reversal of the mandrel closing force F1 and the backing-up roller force F3, the rolling mandrel 5 and the backing-up roller carrier 18 are again brought into the rear position.

After the ring has been changed, the rolling process can start again.

What we claim is:

1. Apparatus for the two-step rolling of a ring, comprising a bearing housing comprising a first bearing housing arranged coaxially with and on one side of a ring to be rolled and a second bearing housing arranged coaxially with and on another side of said ring opposite said one side, said first and second bearing housings being axially adjustable;

a two-step recessed rolling mandrel supported in said bearing housing, said mandrel having formed thereon a rough-rolling profile having a first smaller diameter and a finished-rolling profile having a second larger diameter;

means in said first bearing housing including a first base bushing axially adjustably and non-rotationally receiving said mandrel;

a sleeve disposed in said second bearing housing having an outer diameter substantially equal to the second larger diameter of said finished-rolling profile;

a second base bushing axially-adjustably and non-rotationally receiving said sleeve;

means defining a borehole in said sleeve, said borehole having a diameter substantially equal to the first diameter of said rough-rolling profile; and said mandrel including a plug having a diameter substantially equal to the first diameter of said rough-rolling profile, said plug being adapted to be received and suppported in said borehole, whereby two-step rolling of said ring can be performed in one continuous working sequence without changing the position of said ring.

2. Apparatus according to claim 1, further comprising a principal roller located between said first and second bearing housings for contacting an external surface of said ring on one side of said mandrel;

first and second backing-up rollers; and carrier means for supporting said first and second backing-up rollers between said first and second bearing housings and for removably contacting said backing-up rollers with said external surface of said ring at a side opposite said one side of said mandrel, whereby said ring can be removably held between said principal roller and said backing-up rollers without contacting said mandrel.

* * * * *